United States Patent [19]

Theurer

[11] Patent Number: 5,048,425

[45] Date of Patent: Sep. 17, 1991

[54] BALLAST TAMPING UNIT FOR MOUNTING ON A TAMPING MACHINE AND A TAMPING TOOL THEREFOR

[75] Inventor: Josef Theurer, Vienna, Austria

[73] Assignee: Franz Plasser Bahnbaumaschinen-Industriegesellschaft m.b.H., Vienna, Austria

[21] Appl. No.: 518,122

[22] Filed: May 3, 1990

[30] Foreign Application Priority Data

Jun. 16, 1989 [AT] Austria ..... 1477/89

[51] Int. Cl.[5] ..... E01B 27/02

[52] U.S. Cl. ..... 104/12

[58] Field of Search ..... 104/12, 10

[56] References Cited

U.S. PATENT DOCUMENTS

| | | | |
|---|---|---|---|
| 3,357,366 | 2/1966 | Plasser et al. | 104/12 |
| 3,372,651 | 3/1968 | Plasser et al. | 104/12 |
| 3,429,276 | 6/1967 | Plasser et al. | 104/12 |
| 4,160,419 | 7/1979 | Stewart | 104/10 |
| 4,258,627 | 3/1981 | Theurer | 104/12 |
| 4,404,913 | 9/1983 | Theurer | 104/12 |
| 4,773,333 | 9/1988 | Theurer | 104/12 |

*Primary Examiner*—Robert J. Oberleitner

*Assistant Examiner*—S. Joseph Morano

*Attorney, Agent, or Firm*—Collard, Roe & Galgano

[57] ABSTRACT

A ballast tamping unit for tamping ballast under two successive ties comprises a vertically adjustable tamping tool carrier and a set of two pairs of opposed vibratory and reciprocable tamping tools mounted on the tamping tool carrier, the pairs of tamping tools being so spaced from each other that two adjacent tamping tools of the pairs may be immersed in the crib between two successive ties and two remote tamping tools of the pairs may be immersed in respective cribs adjacent the successive ties. Each tamping tool comprises a tamping pick having a substantially straight shaft having a center axis extending between a lower and an upper end, a tamping jaw at the lower tamping pick shaft end and a tamping pick holder, the upper end of the tamping pick shaft being detachably mounted in the tamping pick holder, the two adjacent tamping tools being reciprocable into an end position wherein the center axes and upper ends thereof substantially extend in a vertical plane extending perpendicularly to the direction of elongation of the track on which the tamping unit is mounted. Drives are connected to the tamping tools for vibrating and reciprocating the tamping tools.

15 Claims, 1 Drawing Sheet

Fig. 1
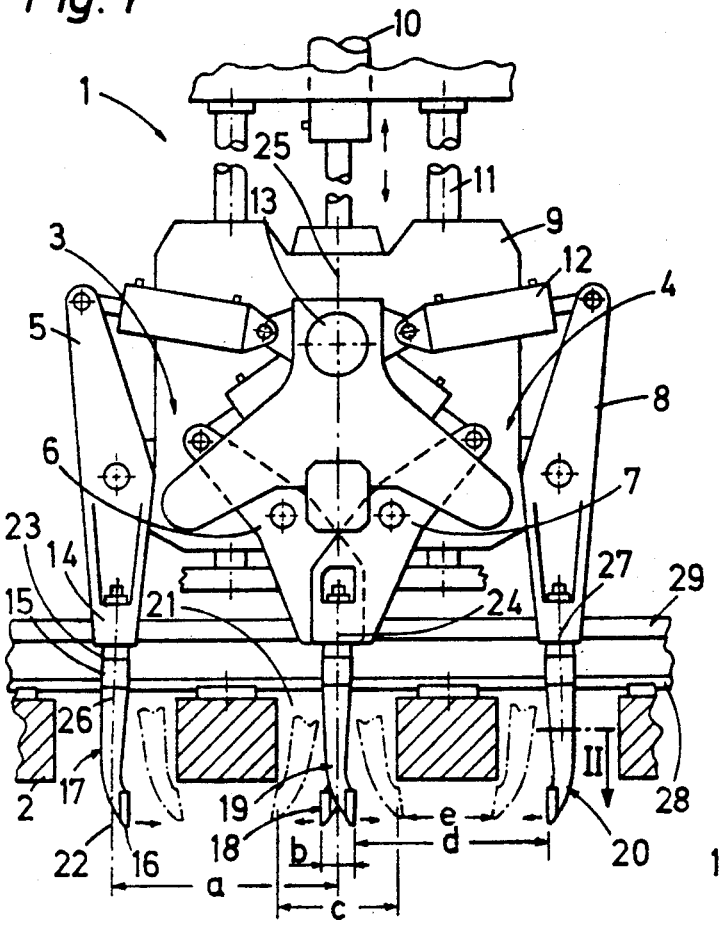
Fig. 3
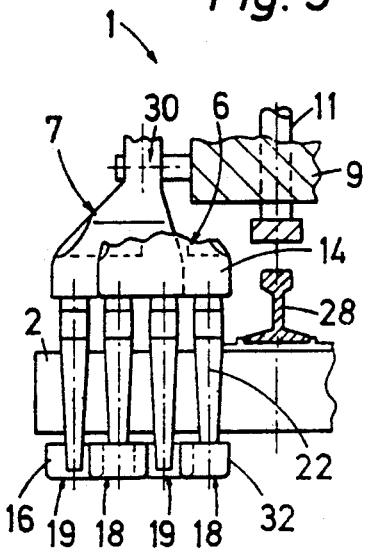
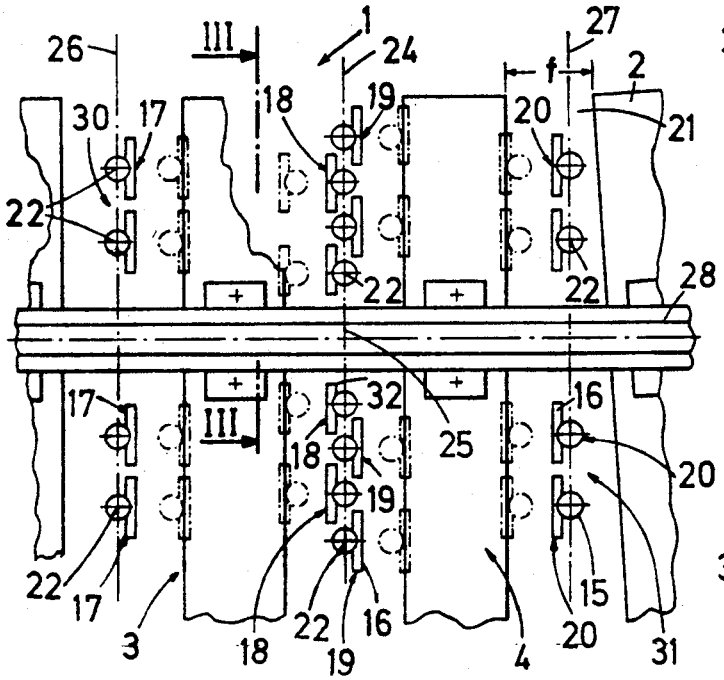
Fig. 2
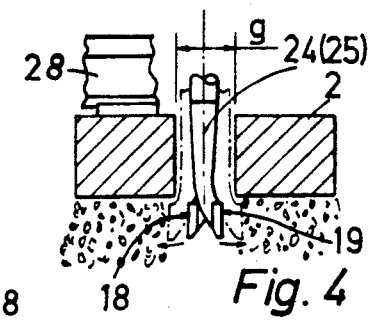
Fig. 4
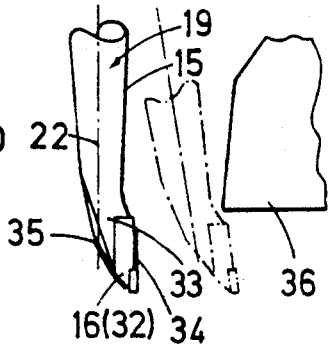
Fig. 5

BALLAST TAMPING UNIT FOR MOUNTING ON A TAMPING MACHINE AND A TAMPING TOOL THEREFOR

BACKGROUND OF THE INVENTION (1) Field of the Invention

The present invention relates to a ballast tamping unit for mounting on a tamping machine adapted to tamp ballast under two successive ties fastened to two rails of a railroad track, the two ties defining a crib therebetween. The tamping unit comprises a vertically adjustable tamping tool carrier, a set of two pairs of opposed vibratory and reciprocable tamping tools mounted on the tamping tool carrier, the pairs of tamping tools being so spaced from each other in the direction of elongation of the track that two adjacent ones of the tamping tools of the pairs may be immersed in the crib between the successive ties and two remote ones of the tamping tools of the pairs may be immersed in respective cribs adjacent the successive ties, each tamping tool comprising a tamping pick having a substantially straight shaft having a center axis extending between a lower and an upper end, a tamping jaw at the lower tamping pick shaft end and a tamping pick holder, the upper end of the tamping pick shaft being detachably mounted in the tamping pick holder, and drive means connected to the tamping tools for vibrating and reciprocating the tamping tools. This invention also relates to a tamping tool for such a ballast tamping unit.

(2) Description of the Prior Art

Such ballast tamping units with twin tamping tools for track leveling, lining and tamping machines are known, for example, from U.S. Pat. Nos. 3,357,366, dated Dec. 12, 1967, No. 3,429,276, dated Feb. 25, 1969, and No. 4,773,333, dated Sept. 27, 1988. These twin tamping units have been commercially very successful because tamping machines incorporating the same are not only very efficient and productive because they enable two ties to be tamped simultaneously during each tamping stage but also because the two adjacent tamping tools immersed in the crib between the two successive ties are reciprocable in opposite directions to provide a very uniform ballast compaction under the two ties. However, tamping of ties separated by relatively narrow cribs or cribs of varying widths often causes problems since the shape of the tamping pick or its arrangement in the tamping pick holder, on the one hand, and the short reciprocating stroke limited by the narrowness of the crib reduces the degree of ballast compaction under the ties effectuated by the reciprocating tamping tools.

As the top view of FIG. 2 of U.S. Pat. No. 3,357,366 shows, the ballast tamping unit has two sets of two pairs of tamping tools arranged at respective sides of at least one of the track rails and along respective longitudinal edges of the two successive ties, the two sets at each track rail side having four adjacent tamping tools and the eight adjacent tamping tools of the four sets being reciprocable into an end position shown in FIG. 1 of the patent wherein the center axes and upper ends thereof substantially enclose an acute angle producing a wedge-shaped formation which allows only a limited reciprocating stroke of the tools in a narrow crib. To reduce this disadvantage, the linkage of the tamping tools is somewhat complex and the tamping jaws are transversely staggered so that the two adjacent tamping tools of each pair may be arranged as closely to each other as possible. This enables the tamping tools to penetrate more readily into encrusted ballast. When the crib widths are quite irregular or when obliquely positioned or double ties under rail abutments are encountered, it is not always possible to center the tamping tools quickly to avoid malfunctions. The outwardly tapering wedge-shaped formation of the two adjacent tamping tools in their one end position is particularly disadvantageous when they are immersed in narrow cribs since reciprocation of the two tamping tools towards the longitudinal edges of the two successive ties will cause the tamping pick shaft to impact on the edges, thus preventing further reciprocation and also damaging the ties.

In the tamping tool disclosed in U.S. Pat. No. 3,429,276, the tamping jaw is of corrugated configuration and the tamping pick shaft of the two adjacent tamping tools immersed in the crib between two successive ties is offset from the upper end of the tamping pick attached to the tamping pick holder. This design enables the tamping stroke of these two tamping tools to be increased so that the machine works satisfactorily in cribs of average width. Therefore, the twin tampers incorporating such tamping tools have had great commercial success but the offset structure of the tamping picks makes their manufacture more complicated than tamping picks with straight shafts. In addition, these tamping tools still fail to permit a sufficient tamping stroke in very narrow cribs.

The ballast tamping unit disclosed in U.S. Pat. No. 4,404,913, dated Sept. 20, 1983, comprises twin pairs of tamping tools so spaced that each pair is immersible in a respective one of two successive cribs, and the tamping tools of each pair are reciprocable towards the two adjacent ties defining each crib so that, during each tamping stage, the tie between the two pairs of tamping tools is fully tamped while only one half of each of the other ties defining the two successive cribs is tamped. In their initial end position upon immersion in the ballast of each crib, the two reciprocable tamping tools of each pair define a wedge-shaped formation and, as explained hereinabove in connection with U.S. Pat. No. 3,357,366, this limits the reciprocating stroke of the tamping tools.

SUMMARY OF THE INVENTION

It is the primary object of the invention to provide a ballast tamping unit and a tamping tool for such a unit for twin tampers designed to tamp ballast under two successive ties simultaneously, which enhances their usefulness due to their effective and trouble-free work in tamping ties in track sections with very narrow cribs or cribs of varying width caused, for example, by obliquely positioned ties.

The above and other objects and advantages are accomplished according to one aspect of the present invention with a ballast tamping unit of the first-described type wherein the two adjacent tamping tools are reciprocable into an end position wherein the center axes and upper ends thereof substantially extend in a vertical plane extending perpendicularly to the direction of elongation of the track.

According to another aspect of this invention, a tamping tool reciprocable to tamp ballast under a tie fastened to two rails of a railroad track comprises a tamping pick having a substantially straight shaft having a center axis extending between a lower and an upper end of the tamping pick, the lower tamping pick end enclosing an angle with the center axis and extending in the direction of reciprocation of the tamping tool, and a substantially plane tamping jaw affixed to the lower tamping pick end, the tamping jaw having a tamping face extending substantially perpendicularly to the track rails.

A ballast tamping unit incorporating this unexpectedly simple design enables all the adjacent tamping tools of the sets of pairs of tamping tools immersed in the same crib to be transversely arrayed in a row in narrow cribs and cribs of varying width while their tamping stroke is sufficient to guarantee uniform and good ballast compaction under the adjacent ties. Furthermore, the tamping tools with their straight tamping pick shafts including the upper end mounted in the tamping pick holder are easy and economically manufactured. The adjacent tamping tools may be readily arrayed in narrow cribs in a minimum of space in a single transverse plane. Since the upper tamping pick ends attached to the tamping tool holders are also located in this plane, the reciprocating stroke of the immersed tamping tools is not unduly restricted so that good ballast compaction is assured. This advantage over the offset tamping tool structure of the prior art is obtained because the upper end of the tamping picks extends in the same transverse plane defined by the center axes of the adjacent tamping tools so that the tools may execute a greater tamping stroke. Thus, the invention for the first time provides a twin ballast tamping unit of unlimited usefulness, even where the cribs are narrow or of varying width. In addition, since the adjacent tamping tools are arranged so closely together, the resistance to their immersion in the ballast upon lowering of the tamping tool carrier is decreased so that they will penetrate even into highly encrusted ballast.

The tamping tool of this invention is not only simple to manufacture but the angled end of the tamping pick shaft carrying the plane tamping jaw will move the tamping jaw slightly below the lower longitudinal edge of the adjacent tie upon reciprocation towards this tie, which will enhance the ballast compaction and thus improve the tie support. This forwardly projecting arrangement of the tamping jaw also enables the same to have a sufficient width for effective tamping without touching the tamping pick shaft of a neighboring tamping tool.

BRIEF DESCRIPTION OF THE DRAWING

The above and other objects, advantages and features of the invention will become more apparent from the following detailed description of a now preferred embodiment thereof, taken in conjunction with the somewhat schematic accompanying drawing wherein FIG. 1 is a side elevational view of a ballast tamping unit according to the present invention;

FIG. 2 is a diagrammatic top view along line II of FIG. 1, showing the array of tamping tools immersed in the ballast, the associated track rail lying above plane II also being shown for a better understanding of the operation;

FIG. 3 is a fragmentary end view along line III—III of FIG. 2, showing the four tamping tools transversely aligned in the center crib at one side of the associated track rail;

FIG. 4 is a fragmentary side elevational view of the two adjacent tamping tools immersed in a crib whose width is about 40% smaller than the average crib width shown in FIGS. 1 and 2; and FIG. 5 is an enlarged fragmentary side elevational view of a tamping tool according to this invention.

DETAILED DESCRIPTION OF THE PREFERRED EMBODIMENT

Referring now to the drawing, there is shown ballast tamping unit 1 for mounting on a tamping machine adapted to tamp ballast under two successive ties 2 fastened to two rails 28 of railroad track 29, the two ties defining crib 21 therebetween. The tamping unit comprises vertically adjustable tamping tool carrier 9 which is vertically displaceable by drive 10 along guide posts 11 affixed to a machine frame of the tamping machine. FIG. 1 shows a set of two pairs 3, 4 of opposed vibratory and reciprocable tamping tools 5 to 8 mounted on tamping tool carrier 9, the pairs of tamping tools being so spaced from each other in the direction of elongation of the track, that tamping picks 18, 19 of two adjacent ones of the tamping tools of pairs 3, 4 may be immersed in crib 21 between the successive ties and tamping picks 17, 20 of two remote ones of the tamping tools of these pairs may be immersed in respective cribs adjacent the successive ties. Each tamping tool comprises tamping pick 17 to 20 having a substantially straight shaft 15 having a center axis 22 extending between a lower and an upper end, tamping jaw 16, 32 at the lower tamping pick shaft end and tamping pick holder 14, upper end 23 of tamping pick shaft 15 being detachably mounted in tamping pick holder 14. According to the invention, the two adjacent tamping tools with their tamping picks 18, 19 are reciprocable into an end position (shown in full lines in FIG. 1) wherein center axes 22 and upper ends 23 thereof substantially extend in vertical plane 24 extending perpendicularly to the direction of elongation of the track rails. Reciprocating drives 12 and common vibrating drive 13 are connected to tamping tools 5 to 8 for vibrating and reciprocating the tamping tools in a conventional manner.

According to a preferred feature of the present invention, vertical plane 24 extending perpendicularly to the direction of elongation of the tamping machine constitutes transverse plane of symmetry 25 of tamping unit 1. This arrangement enables the impact forces encountered by the immersion of the tamping picks into the ballast to be distributed evenly over the ballast tamping unit and its support posts 11.

As is conventional and shown, for example, in the hereinabove cited patents, ballast tamping unit 1 comprises two sets 30, 31 of pairs 3, 4 of tamping tools 5 to 8 arranged at respective sides of an associated track rail, the two sets at each track rail side having four of the adjacent tamping tools and the eight adjacent tamping tools of the four sets being reciprocable into an end position wherein the center axes and upper ends thereof substantially extend in vertical plane 24, i.e. plane of symmetry 25, as clearly shown in FIG. 2. In such a ballast unit with a total of 16 tamping picks, the illustrated array of the adjacent tamping tools immersed in the same crib is of particular advantage since the great number of tools require a corresponding space to accommodate them, which makes their immersion in one crib more difficult to manage.

In accordance with another preferred feature and as illustrated in FIG. 2, tamping jaws 32 of adjacent tamping tools 6, 7 directly adjacent the respective track rail sides are arranged asymmetrically with respect to center axes 22 of tamping picks 18, 19 thereof and mirror-symmetrically with respect to each other, tamping jaw portions of different sizes extending from the center axes substantially parallel to vertical plane 24. As shown, the tamping jaw portion of each adjacent tamping tool 6, 7 extending from the center axis 22 towards the adjacent track rail side is smaller than the other tamping jaw portion. This special arrangement of the tamping jaws on the tamping picks immediately adjacent associated track rail 28 enables these tamping tools to be better positioned with respect to the associated rail and the ballast portion underlying the intersection between the rail and the tie, which actually supports the track on the ballast bed. This arrangement concentrates the tamping pressure on this point of intersection.

As also shown in the preferred embodiment illustrated in FIG. 2, tamping picks 17, 18 and 19, 20 of opposed tamping tools 5, 6 and 7, 8 of each pair 3, 4 are staggered from each other in a direction extending transversely to the direction of elongation of the track. This transversely staggered arrangement of the tamping picks of each cooperating pair of tamping tools enables all the tamping pick shafts at one side of the associated track rail to be simply and symmetrically positioned with respect to a vertical plane of symmetry extending at this track rail side perpendicularly to vertical plane of symmetry 25 of the tamping unit. This improves the uniformity of the ballast compaction under the ties by the reciprocation of the tamping tools.

Tamping pick shafts 15 of the four adjacent tamping tools 6, 7 of the two sets at each track rail side are equidistantly spaced in a direction extending transversely to the direction of elongation of the track, the equidistant spacing of the tamping pick shafts preferably corresponding substantially to the width of the tamping jaws. This spacing prevents any interference of the reciprocating movement of the tamping tools by neighboring tools while at the same time enabling the tamping tools to be spaced as closely together as possible to assure proper tamping and to simplify the mounting of the tamping tools on the tamping tool carrier.

The two remote tamping tools 5, 8 of each pair 3, 4 are reciprocable into an end position (shown in full lines in FIG. 1) wherein center axes 22 and upper ends 23 thereof substantially extend in respective vertical planes 26, 27 extending perpendicularly to the direction of elongation of track, spacing a between the three vertical planes 24, 26, 27 wherein center axes 22 of adjacent tamping tools 6, 7 and of remote tamping tools 5, 8 respectively extend corresponding substantially to the average width c of the cribs. This spacing between the three vertical planes is preferably about 520 mm. This arrangement of all the tamping picks in three transverse vertical planes enables them to be centered rapidly with respect to three adjacent cribs for immersion therein, which is of particular advantage if the cribs are narrow. It is equally useful in cribs defined by obliquely positioned ties 2, as shown on the right of FIG. 2, where the obliquely positioned ties narrow the width of crib 21 to spacing f between the two successive ties.

Spacing b between the tamping jaws of the two adjacent tamping tools 6, 7 of pairs 3, 4 in the open end position corresponds substantially to about a quarter of average width c of the cribs in the direction of elongation of the track, i.e. does not exceed about 75 mm. This maximal spacing of the tamping jaws of the adjacent tamping tools enables their immersion in very narrow cribs while maintaining the quality of the tie tamping. At the same time, the spacing is sufficient to avoid any mutual interference and contact by and with each other during the vibration of the tamping tools. Spacing d shows the distance between opposing tamping picks 17, 18 and 19, 20 of pairs 3, 4 in the open end position of the tamping tools before the tamping picks are immersed in the ballast. In the illustrated embodiment, spacing d is about 453 mm. Spacing d shows the distance between the opposing tamping picks in the opposite, closed end position (illustrated in chain-dotted lines) when the picks are immersed in the ballast. In the illustrated embodiment, spacing e is about 240 mm.

As shown in FIG. 4, the two adjacent tamping tools of pairs 3, 4, with their tamping picks 18, 19, are reciprocable into an opposite end position (shown in chain-dotted lines) respectively adjacent successive ties 2, 2 whereby the ballast is tamped under the two successive ties to a desired degree of compaction, spacing g between the tamping picks of the adjacent tamping tools at the tamping jaws in the opposite end positions being about 40% of the average width of the cribs, as seen by comparing the average width of cribs 21 in FIGS. 1 and 2 with the crib width shown in FIG. 4. Spacing g preferably is about 11 cm. With the present array of the adjacent tamping tools along a single transverse vertical plane in the common crib, even an end spacing corresponding to no more than about 40% of the normal crib width suffices to provide adequate ballast compaction. This is accomplished because, while the upper ends of these tamping picks remain relatively closely spaced at the closing end position, the two tamping picks form an upwardly tapering wedge configuration at this closing end position so that the upper longitudinal edges of the adjacent ties do not interfere with the reciprocating movement. In other words, the reciprocating stroke of the lower tamping pick ends carrying the tamping jaws remains sufficiently large to assure high-quality tamping.

As shown in FIG. 3, according to a preferred feature of the present invention, each adjacent tamping tool 6, 7 of pairs 3, 4 comprises two tamping picks 18, 19 arranged like tines of a fork, the tamping picks 18 of one adjacent tamping tool 6 alternating with tamping picks 19 of the other adjacent tamping tool 7 in transverse plane 24. This interengaging arrangement of fork-like tamping tools enables the tamping tools to be very closely spaced without interfering with each other during reciprocation, and such an arrangement makes it possible to immerse the tamping tools even in very narrow cribs. In addition, this mounting is not only simple but also very robust so that the tamping picks and their tamping jaws may absorb strong pressures during their reciprocating tamping stroke.

The enlarged view of FIG. 5 shows a tamping tool reciprocable (see full-line and chain-dotted line positions) to tamp ballast under concrete tie 36 fastened to two rails of a railroad track in the manner of wooden ties 2 shown in FIGS. 1–4. The tamping tool comprises tamping pick 19 having substantially straight shaft 15 having center axis 22 extending between lower end 35 and an upper end of the tamping pick (not shown). Lower tamping pick end 35 encloses an angle with the center axis and extends in the direction of reciprocation of the tamping tool to form angled tamping pick end portion 33. Substantially plane tamping jaw 16, 32 is affixed to lower tamping pick end portion 33, the tamping jaw having a tamping face 34 extending substantially perpendicularly to the track rails. The spacing between tamping jaw face 34 and center axis 22 in the direction of reciprocation of the tamping tool is about 35 mm so that the tamping jaw will be reciprocated into a position just below the lower longitudinal edge of tie 36 for most effective tamping. The tamping jaw is welded to the lower tamping pick end.

What is claimed is:

1. A ballast tamping unit for mounting on a tamping machine adapted to tamp ballast under two successive ties fastened to two rails of a railroad track, the two ties defining a crib therebetween, the tamping unit comprising (a) a vertically adjustable tamping tool carrier, (b) a set of two pairs of opposed vibratory and reciprocable tamping tools mounted on the tamping tool carrier, the pairs of tamping tools being so spaced from each other in the direction of elongation of the track that two adjacent ones of the tamping tools of said pairs may be immersed in the crib between the successive ties and two remote ones of the tamping tools of said pairs may be immersed in respective cribs adjacent the successive ties, each tamping tool comprising (1) a tamping pick having a substantially straight shaft having a center axis extending between a lower and an upper end, (2) a tamping jaw at the lower tamping pick shaft end and (3) a tamping pick holder, the upper end of the tamping pick shaft being detachably mounted in the tamping pick holder, (4) the two adjacent tamping tools being reciprocable into an end position wherein the center axes and upper ends thereof substantially extend in a vertical plane extending perpendicularly to the direction of elongation of the track, and (c) drive means connected to the tamping tools for vibrating and reciprocating the tamping tools.

2. The ballast tamping unit of claim 1, wherein the vertical plane extending perpendicularly to the direction of elongation of the track constitutes a transverse plane of symmetry of the tamping unit.

3. The ballast tamping unit of claim 1, comprising two of said sets of pairs of tamping tools arranged at respective sides of at least one of the track rails, the two sets at each track rail side having four of said adjacent tamping tools and the eight adjacent tamping tools of the four sets being reciprocable into an end position wherein the center axes and upper ends thereof substantially extend in said vertical plane.

4. The ballast tamping unit of claim 3, wherein the tamping jaws of the adjacent tamping tools directly adjacent the respective track rail sides are arranged asymmetrically with respect to the center axes of the tamping picks thereof and mirror-symmetrically with respect to each other, tamping jaw portions of different sizes extending from the center axes substantially parallel to said vertical plane.

5. The ballast tamping unit of claim 4, wherein a tamping jaw portion of each adjacent tamping tool extending from the center axis towards the adjacent track rail side is smaller than the other tamping jaw portion.

6. The ballast tamping unit of claim 3, wherein the tamping picks of the opposed tamping tools of each pair are staggered from each other in a direction extending transversely to the direction of elongation of the track.

7. The ballast tamping unit of claim 3, wherein the tamping pick shafts of the four adjacent tamping tools of the two sets at each track rail side are equidistantly spaced in a direction extending transversely to the direction of elongation of the track.

8. The ballast tamping unit of claim 7, wherein the equidistant spacing of the tamping pick shafts corresponds substantially to the width of the tamping jaws.

9. The ballast tamping unit of claim 3, wherein the two remote tamping tools of each of said pairs are reciprocable into an end position wherein the center axes and upper ends thereof substantially extend in respective vertical planes extending perpendicularly to the direction of elongation of the track, the spacing between the three vertical planes wherein the center axes of the adjacent tamping tools and of the remote tamping tools respectively extend corresponding substantially to the average width of the cribs.

10. The ballast tamping unit of claim 9, wherein the spacing between the three vertical planes is about 520 mm.

11. The ballast tamping unit of claim 1, wherein the spacing between the tamping jaws of the two adjacent tamping tools of said pairs in said end position corresponds substantially to about a quarter of the average width of the cribs in the direction of elongation of the track.

12. The ballast tamping unit of claim 11, wherein the spacing between the tamping jaws does not exceed about 75 mm.

13. The ballast tamping unit of claim 1, wherein the two adjacent tamping tools of said pairs are reciprocable into an opposite end position respectively adjacent the successive ties whereby the ballast is tamped under the two successive ties to a desired degree of compaction, the spacing between the tamping picks of the adjacent tamping tools at the tamping jaws in the opposite end positions being about 40% of the average width of the cribs.

14. The ballast tamping unit of claim 13, wherein the spacing is about 11 cm.

15. The ballast tamping unit of claim 1, wherein each one of the adjacent tamping tools of said pairs comprises two of said tamping picks arranged as tines of a fork, the tamping picks of one of the adjacent tamping tools alternating with the tamping picks of the other adjacent tamping tool in said transverse plane.

* * * * *